US007540275B2

(12) United States Patent
Otani et al.

(10) Patent No.: US 7,540,275 B2
(45) Date of Patent: Jun. 2, 2009

(54) ACCUMULATOR-TYPE FUEL INJECTION APPARATUS AND INTERNAL COMBUSTION ENGINE PROVIDED WITH THAT ACCUMULATOR-TYPE FUEL INJECTION APPARATUS

(75) Inventors: Tomohiro Otani, Osaka (JP); Hitoshi Adachi, Osaka (JP); Fumiya Kotou, Osaka (JP); Hideo Shiomi, Osaka (JP)

(73) Assignee: Yanmar Co., Ltd., Osaka-Shi (JP)

( * ) Notice: Subject to any disclaimer, the term of this patent is extended or adjusted under 35 U.S.C. 154(b) by 138 days.

(21) Appl. No.: 11/631,960

(22) PCT Filed: Jul. 7, 2005

(86) PCT No.: PCT/JP2005/012576

§ 371 (c)(1),
(2), (4) Date: Jan. 9, 2007

(87) PCT Pub. No.: WO2006/006495

PCT Pub. Date: Jan. 19, 2006

(65) Prior Publication Data

US 2007/0186907 A1 Aug. 16, 2007

(30) Foreign Application Priority Data

Jul. 12, 2004 (JP) ..... 2004-204351
Jul. 12, 2004 (JP) ..... 2004-204352

(51) Int. Cl.
*F02M 37/04* (2006.01)
*F02M 37/06* (2006.01)

(52) U.S. Cl. ..... 123/508

(58) Field of Classification Search ..... 123/507, 123/508, 456, 447, 446
See application file for complete search history.

(56) References Cited

U.S. PATENT DOCUMENTS 5,899,181 A * 5/1999 Kurata et al. ..... 123/90.17
6,019,692 A * 2/2000 Kojima et al. ..... 474/87

FOREIGN PATENT DOCUMENTS

| | | |
|---|---|---|
| JP | 9-236065 | 9/1997 |
| JP | 2002-213326 | 7/2002 |
| JP | 2003-148222 | 5/2003 |

* cited by examiner

*Primary Examiner*—Mahmoud Gimie
(74) *Attorney, Agent, or Firm*—Edwards Angell Palmer & Dodge LLP

(57) ABSTRACT

In one embodiment, the high-pressure pump (8) for providing a pressurized supply of fuel in an engine furnished with a common rail type fuel injection apparatus is provided with two actuators (88, 89). Of these actuators (88, 89), one (88) is stopped and the operation for providing a pressurized supply of fuel is performed from only the other actuator (89), so that the timing at which the load torque that acts on the crankshaft of the engine becomes a local maximum and the timing at which the load torque that acts on the driveshaft of the high-pressure pump (8) becomes a local minimum are made to coincide with one another.

4 Claims, 8 Drawing Sheets

ACCUMULATOR-TYPE FUEL INJECTION APPARATUS AND INTERNAL COMBUSTION ENGINE PROVIDED WITH THAT ACCUMULATOR-TYPE FUEL INJECTION APPARATUS

TECHNICAL FIELD

The invention relates to accumulator-type (common rail type) fuel injection apparatuses, and internal combustion engines provided with those accumulator-type fuel injection apparatuses, that are furnished with an accumulator piping (so-called "common rail") that is adopted for the fuel supply system of internal combustion engines (such as diesel engines). In particular, the invention relates to measures for allowing the idling revolution to be set low while suppressing vibration of the internal combustion engine, and measures for making it possible to adjust the common rail internal pressure with high precision.

BACKGROUND ART

In the past, accumulator-type fuel injection apparatuses, which have superior controllability compared to mechanical fuel injection pump-nozzle type apparatuses, have been proposed as the fuel supply system in multi-cylinder diesel engines, etc. (for example, see Patent Documents 1 and 2 listed below).

Such fuel injection apparatuses hold, in a common rail, fuel that has been pressurized to a predetermined pressure by a high-pressure pump, and this fuel that is held in the common rail is injected into the combustion chamber from a predetermined injector in accordance with a fuel ejection timing. A controller performs calculations to control the fuel pressure within the common rail (hereinafter, called the common rail internal pressure) and the injectors so that fuel is injected under the most suitable injection conditions for the operating state of the engine.

Thus, in accumulator-type fuel injection apparatuses it is possible to control not only the fuel injection amount and the injection timing, but also the fuel injection pressure, which is determined by the common rail internal pressure, according to the operating state of the engine, and thus they have gained attention as injection apparatuses with excellent controllability. In particular, such accumulator-type fuel injection apparatuses have favorable pressure increase properties in the low revolution region of the engine, and thus high-pressure fuel injection is possible from the low revolution region and it is possible to perform the idling operation at low revolutions, which was unachievable with conventional mechanical-type fuel injection apparatuses. Specifically, in conventional mechanical-type fuel injection apparatuses it was only possible to achieve low revolutions of about 500 rpm, but with accumulator-type fuel injection apparatuses it is possible to achieve idling operation at about 250 rpm. Because idling operation can be performed at low revolutions, it is possible to achieve a reduction in noise and conserve fuel use during idling operation.

Fuel pumps that are provided with a plurality of pressurized fuel supply systems, such as that disclosed in the following Patent Document 3, are known as an example of the high-pressure pump that is used in this type of accumulator-type fuel injection apparatus Patent Document 1: JP 2000-18052A Patent Document 2: JP 2003-328830 A Patent Document 3: JP 2004-84538 A

DISCLOSURE OF THE INVENTION

Problem to be Solved by the Invention

However, although accumulator-type fuel injection apparatuses allow a low idling revolution to be set as discussed above, simply setting a low idling revolution will result in the problem of increased movement during the compression stroke and the expansion stroke of the engine and therefore cause larger vibration in the engine.

FIG. 9 is a diagram that shows an example of the relationship between the engine revolution and the amplitude of the vibration of the engine in the idling operation region. For example, the engine revolution range R1 in the drawing is a range that can be achieved with even conventional mechanical-type fuel injection apparatuses, whereas the engine revolution range R2 in the drawing is a range that cannot be attained in conventional mechanical-type fuel injection apparatuses but that can be achieved by adopting an accumulator-type fuel injection apparatus. In this engine revolution range R2 that can be achieved only by an accumulator-type fuel injection apparatus, the amplitude of vibration in the engine abruptly increases the lower the engine revolution is set. Thus, although adopting an accumulator-type fuel injection apparatus allows the engine revolution to be lowered down to the engine revolution range R2, from the standpoint of engine vibration it was not possible to actually carry out idling operation in this engine revolution range R2. That is to say, owing to this engine vibration, it has not been possible to sufficiently take advantage of the merits of adopting an accumulator-type fuel injection apparatus, and there was still room for improvement before idling operation at low revolutions could be achieved to reduce noise and curtail fuel consumption.

On the other hand, the common rail internal pressure has a significant impact on engine performance, and to achieve higher engine output, lower fuel consumption, and lower emissions, it is necessary to perform control with high precision over a wide range of low to high common rail internal pressures according to the operation state. However, to control the common rail internal pressure over a wide range within the entire operable region of the engine, and in particular, to achieve a high common rail internal pressure under high-revolution, high-injection amount conditions, it is necessary to increase the volume of fuel that is delivered to the rail from the pump. When the amount of fuel that is delivered from the pump to the rail (hereinafter, the pump ejection amount) is accordingly increased, the plunger diameter and the lift amount of the pump increase and the precision of control of the ejection amount deteriorates, and the result is that the common rail internal pressure control precision becomes worse.

The invention was arrived at in light of the above matters, and it is an object thereof to provide an internal combustion engine that is provided with an accumulator-type fuel injection apparatus with which it is possible to set a low idling revolution while suppressing vibration in the internal combustion engine. It is another object thereof to provide an accumulator-type fuel injection apparatus, and an internal combustion engine that is provided with that accumulator-type fuel injection apparatus, that allows the common rail internal pressure to be adjusted with high precision over the entire operable region of the engine.

Means for Solving Problem

One means of solution of the invention that has been arrived at in order to achieve the foregoing objects is to link the driveshaft (crankshaft) of the engine and the driveshaft of the fuel pump so that the load torque that acts on the driveshaft of the engine and the load torque that acts on the driveshaft of the fuel pump cancel each other out, and by doing this, fluctuation in the total load torque is suppressed. That is, making the timing at which the load torque that acts on the driveshaft of the engine becomes a local maximum and the timing at which the load torque that acts on the driveshaft of the fuel pump becomes a local minimum coincide with one another suppresses fluctuation in the total load torque, which is arrived at by superimposing the two torques, and thus allows idling operation at low revolutions to be achieved.

Specifically, the invention premises an internal combustion engine furnished with an accumulator-type fuel injection apparatus comprising a fuel pump that receives a drive force from a driveshaft of a main internal combustion engine unit through motive force transmission means and performs an operation to provide a pressurized supply of fuel, a common rail for holding the fuel that has been supplied under pressure from the fuel pump, and a fuel injection valve that injects fuel that has been supplied from the common rail toward a combustion chamber of the main internal combustion engine unit. In the internal combustion engine furnished with this accumulator-type fuel injection apparatus, the driveshaft of the main internal combustion engine unit and the driveshaft of the fuel pump are linked by the motive force transmission means with the rotation phases of the driveshafts coordinated with one another so that the timing at which a load torque that acts on the driveshaft of the main internal combustion engine unit becomes a local maximum and the timing at which a load torque that acts on the driveshaft of the fuel pump becomes a local minimum substantially coincide.

More specifically, the driveshaft of the main internal combustion engine unit and the driveshaft of the fuel pump are linked by the motive force transmission means in such a manner that the load torque fluctuation cycle of the driveshaft of the main internal combustion engine unit and the load torque fluctuation cycle of the driveshaft of the fuel pump are made to substantially coincide with one another, the timing at which the load torque that acts on the driveshaft of the main internal combustion engine unit becomes a local maximum and the timing at which the load torque that acts on the driveshaft of the fuel pump becomes a local minimum are made to substantially coincide with one another, and the timing at which the load torque that acts on the driveshaft of the main internal combustion engine unit becomes a local minimum and the timing at which the load torque that acts on the driveshaft of the fuel pump becomes a local maximum are made to substantially coincide with one another.

According to these specific features, when driving the main internal combustion engine unit, the fuel that has been supplied under pressure by the fuel pump to, and held in, the common rail is supplied to the fuel injection valve at a predetermined timing, and this fuel is injected from the fuel injection valve toward a combustion chamber. In the main internal combustion engine unit, a load torque acts on the drive shaft, and this load torque fluctuates in a periodic manner. In particular, the load torque becomes a local maximum at the point in time that the compression stroke ends. In a case where the internal combustion engine has a plurality of cylinders, the load torque becomes a local minimum at the point in time midway between the point that the compression stroke of one cylinder ends and the point that the compression stroke ends in the cylinder that performs the next compression stroke. On the other hand, the fuel pump receives the drive force of the main internal combustion engine unit through the motive force transmission means and performs an operation to provide a pressurized supply of fuel to the common rail. In the fuel pump as well, a load torque acts on its driveshaft, and this load torque fluctuates in a periodic manner. In particular, the load torque becomes a local maximum at the point in time that the fuel pump starts supplying fuel under pressure. In a case where the fuel pump is furnished with a plurality of pressurized supply chambers (pump chambers), the load torque becomes a local minimum at the point in time midway between the point that the pressurized supply of fuel starts in one pressurized supply chamber and the point that he pressurized supply of fuel starts in the pressurized supply chamber that next performs a pressurized supply stroke.

In this way, the load torque on the driveshaft of the main internal combustion engine unit and the driveshaft of the fuel pump fluctuates in a periodic manner, and thus if the driveshaft of the main internal combustion engine unit and the driveshaft of the fuel pump are linked by the motive force transmission means in such a manner that the timing at which the load torque that acts on the driveshaft of the main internal combustion engine unit becomes a local maximum and the timing at which the load torque that acts on the driveshaft of the fuel pump becomes a local minimum are made to substantially coincide with one another, and the timing at which the load torque that acts on the driveshaft of the main internal combustion engine unit becomes a local minimum and the timing at which the load torque that acts on the driveshaft of the fuel pump becomes a local maximum are made to substantially coincide with one another, then it is possible to suppress fluctuation in the total load torque. In particular, it is possible to suppress that vibration during idling operation, in which there is a concern that the vibration of the internal combustion engine will become large, and this allows the act of idling operation at low revolutions by adopting an accumulator-type fuel injection apparatus to be achieved while suppressing vibration in the internal combustion engine. The result is that it is possible to reduce noise during idling operation and curtail fuel consumption.

Examples of configurations in which a switch is made to an operation for suppressing fluctuation in the total load torque by changing the pressurized fuel supply operation of the fuel pump are described below. That is, in one configuration, the fuel pump is furnished with a plurality of pressurized supply chambers, each of which performs the operation to provide a pressurized supply of fuel at a different timing, and these pressurized supply chambers are divided into a plurality of groups, each of which is furnished with a pressurized supply amount control mechanism for adjusting the amount of fuel that is supplied under pressure from the pressurized supply chambers to the common rail. Also, by selectively driving only part of the plurality of pressurized supply amount control mechanisms, fuel is supplied under pressure to the common rail from only the pressurized supply chambers of a specific group or groups, and by doing this, the load torque fluctuation cycle of the fuel pump is made to substantially coincide with the load torque fluctuation cycle of the internal combustion engine, the timing at which the load torque that acts on the driveshaft of the fuel pump becomes a local minimum is made to substantially coincide with the timing at which the load torque that acts on the driveshaft of the main internal combustion engine unit becomes a local maximum, and the timing at which the load torque that acts on the driveshaft of the fuel pump becomes a local maximum is made to substantially coincide with the timing at which the load torque that acts on the driveshaft of the main internal combustion engine unit becomes a local minimum.

More specifically, in this configuration, the main internal combustion engine unit is a multi-cylinder four-stroke engine, the fuel pump is provided with the same number of pressurized supply chambers as the number of cylinders in the main internal combustion engine unit, and these pressurized supply chambers are grouped half into a first group and half into a second group and each group is furnished with a pressurized supply amount control mechanism. Also, when the operation to provide a pressurized supply of fuel has been performed from only the pressurized supply chambers of the second group, the driveshaft of the main internal combustion engine unit and the driveshaft of the fuel pump are linked by the motive force transmission means in such a manner that the timing at which the load torque that acts on the driveshaft of the fuel pump becomes a local minimum substantially coincides with the timing at which the load torque that acts on the driveshaft of the main internal combustion engine unit becomes a local maximum, and the timing at which the load torque that acts on the driveshaft of the fuel pump becomes a local maximum substantially coincides with the timing at which the load torque that acts on the driveshaft of the main internal combustion engine unit becomes a local minimum. Further, by driving only the pressurized supply amount control mechanism of the second group, of the two pressurized supply amount control mechanisms, fluctuation in the total load torque, which is arrived at by superimposing the two load torques, is suppressed.

For example, when there is a demand for high revolution operation by the internal combustion engine (when the load is high), it is necessary to ensure that a large amount of fuel to be supplied under pressure to the common rail per unit time, and thus all of the pressurized supply amount control mechanisms are driven to sequentially perform the pressurized supply of fuel to the common rail from every pressurized supply chamber. On the other hand, when the internal combustion engine is operating at low revolutions, such as when idling, it is sufficient for a smaller amount of fuel to be supplied under pressure to the common rail, and thus only part of the pressurized supply amount control mechanisms are driven so as to effect the pressurized supply of fuel to the common rail from only the pressurized supply chambers of a specific group or groups. By doing this, the load torque fluctuation cycle of the fuel pump substantially coincides with the load torque fluctuation cycle of the internal combustion engine, allowing fluctuation in the total load torque to be suppressed. In other words, it is possible to suppress vibration in the internal combustion engine during idling operation, in which there is a concern that the vibration of the internal combustion engine will become large.

It is an object of another means of solution of the invention arrived at in order to achieve the foregoing objects to forcibly stop part of the pressurized fuel supply systems in an accumulator-type fuel injection apparatus provided with a high-pressure pump that includes a plurality of pressurized fuel supply systems, so as to lower the pump ejection capacity and increase the pump ejection control precision, and thereby improve the rail pressure control precision.

Specifically, the invention premises an accumulator-type fuel injection apparatus that is furnished with pressurized fuel supply means for delivering fuel under pressure, a common rail for holding the fuel that has been supplied under pressure from the pressurized fuel supply means, and a fuel injection valve that injects fuel that has been supplied from the common rail toward a combustion chamber of a main internal combustion engine unit. In this accumulator-type fuel injection apparatus, the pressurized fuel supply means is provided with a plurality of pressurized fuel supply units having pressurized supply passages that are independent of one another. The accumulator-type fuel injection apparatus further comprises pressurized supply unit control means for forcibly stopping part of the pressurized fuel supply units when a fuel demand by the main internal combustion engine unit is less than or equal to a predetermined amount, so that only the remaining pressurized fuel supply units perform the operation of providing a pressurized supply of fuel to the common rail.

According to these specific features, if, for example, the internal combustion engine is operating at high revolutions and the fuel demand by the main internal combustion engine unit exceeds a predetermined value (for example, if the fuel demand cannot be met unless all pressurized fuel supply units are driven), then all of the pressurized fuel supply units are driven to provide a pressurized supply of fuel to the common rail. In contrast to this, if, for example, the internal combustion engine is operating at low revolutions and the fuel demand by the main internal combustion engine unit is equal to or less than a predetermined value (for example, if the fuel demand can be met by driving only part of the pressurized fuel supply units), then the pressurized supply unit control means forcibly stops part of the pressurized fuel supply units. By doing this, only the remaining fuel pressure-supply units supply fuel under pressure to the common rail. When only the remaining fuel pressure-supply units provide a pressurized supply of fuel to the common rail in this way, the amount ejected from the pressurized fuel supply means (fuel pump) becomes half that when all of the pressurized fuel supply units are driven. The result is that adjustment error in the pressurized fuel supply means overall can be reduced, and this allows the adjustment precision to be increased. For example, in an apparatus provided with two pressurized fuel supply units in which there is the possibility of an adjustment error of several percent, forcibly stopping one of the pressurized fuel supply units reduces the adjustment error to half that of a case where both pressurized fuel supply units are driven. Along with this, the common rail internal pressure control error also is halved.

In a specific example of control by the pressurized supply unit control means to switch the number of pressurized fuel supply units to drive, the pressurized supply unit control means switches between operation in which all of the pressurized fuel supply units are driven and operation in which part of the pressurized fuel supply units are forcibly stopped, according to the operating revolution of the main internal combustion engine unit and the fuel injection amount of the fuel injection valve. As one example, it is possible to ready a map for setting the number of pressurized fuel supply units to drive based on the operating revolution and the fuel injection amount, and for the number of pressurized fuel supply units to drive to be set from this map according to the detected operating revolution and fuel injection amount. It should be noted that it is also possible to detect the engine operation state using the engine output torque in lieu of the fuel injection amount.

The following is an example of the operation in a case where the control operation by the pressurized supply unit control means is to be forcibly canceled. Transition determination means for determining whether or not the main internal combustion engine unit is operating in a transient state is provided. Also, the configuration of the pressurized supply unit control means is such that it receives a signal from the transition determination means, and when the main internal combustion engine unit is operating in a transient state, the pressurized supply unit control means cancels the operation in which part of the pressurized fuel supply units are forcibly stopped and drives all of the pressurized fuel supply units so that they provide a pressurized supply of fuel to the common rail. As an example, at a time of transition, such as when a demand for a sudden increase in revolution by the internal combustion engine has arisen, in order to meet that demand, all of the pressurized fuel supply units are driven to supply fuel under pressure to the common rail, regardless of detected values such as the detected value of the common rail internal pressure.

Further, it is configured such that when switching the number of pressurized fuel supply units to drive, the pressurized supply unit control means gives hysteresis to the determination value for determination of that switching. By doing this, it is possible to avoid the hunting phenomenon that the number of pressurized fuel supply units to drive is switched frequently, and thus the stability of the drive operation of the pressurized fuel supply means can be maintained.

In addition, the scope of the technical idea of the invention also includes an internal combustion engine furnished with an accumulator-type fuel injection apparatus according to any one of the means of solution discussed above.

Effects of the Invention

With the present invention, the timing at which the load torque that acts on the driveshaft of the engine becomes a local maximum and the timing at which the load torque that acts on the driveshaft of the fuel pump becomes a local minimum are made to coincide with one another so as to suppress fluctuation in the total load torque, which is obtained by superimposing the load torque that acts on the driveshaft of the engine and the load torque that acts on the driveshaft of the fuel pump. Thus, a large vibration does not occur in the internal combustion engine even when idling at low revolutions, and by achieving idling operation at low revolutions, it becomes possible to reduce noise and curtail fuel consumption. In other words, it becomes possible to sufficiently take advantage of the merits of adopting an accumulator-type fuel injection apparatus, which is that it becomes possible to achieve idling operation at low revolutions.

Further, in an accumulator-type fuel injection apparatus furnished with pressurized fuel supply means having a plurality of pressurized fuel supply units that are independent of each other, if part of the pressurized fuel supply systems are forcibly stopped so as to improve the adjustment precision, then it becomes possible to keep the common rail internal pressure at a target pressure with high precision, and as a result, the fuel injection amount from the fuel injection valve can be appropriately controlled.

DESCRIPTION OF REFERENCE NUMERALS

1 injector (fuel injection valve)
2 common rail
8 high-pressure pump (fuel pump or pressurized fuel supply means)
8A first pump chamber group (first group or pressurized fuel supply unit)
81 first pump mechanism
81*a* first pump chamber (pressurized supply chamber)
82 second pump mechanism
82*a* second pump chamber (pressurized supply chamber)
83 third pump mechanism
83*a* third pump chamber (pressurized supply chamber)
8B second pump chamber group (second group or pressurized fuel supply unit)
84 fourth pump mechanism
84*a* fourth pump chamber (pressurized supply chamber)
85 fifth pump mechanism
85*a* fifth pump chamber (pressurized supply chamber)
86 sixth pump mechanism
86*a* sixth pump chamber (pressurized supply chamber)
88, 89 actuators (pressurized supply amount control mechanisms)
12 controller
12A instructed revolution calculation means
12B injection amount computation means
12C revolution calculation means
12D actuator control means
112 controller
112D pressurized supply unit control means
112E transition determination means
E main engine unit (main internal combustion engine unit)

BEST MODE FOR CARRYING OUT THE INVENTION

Embodiments of the present invention are described below with reference to the drawings.

First Embodiment

In the first embodiment, a case in which the invention is adopted in a six-cylinder marine diesel engine is described.

-Description of the Configuration of the Fuel Injection Apparatus-

Figure 1:
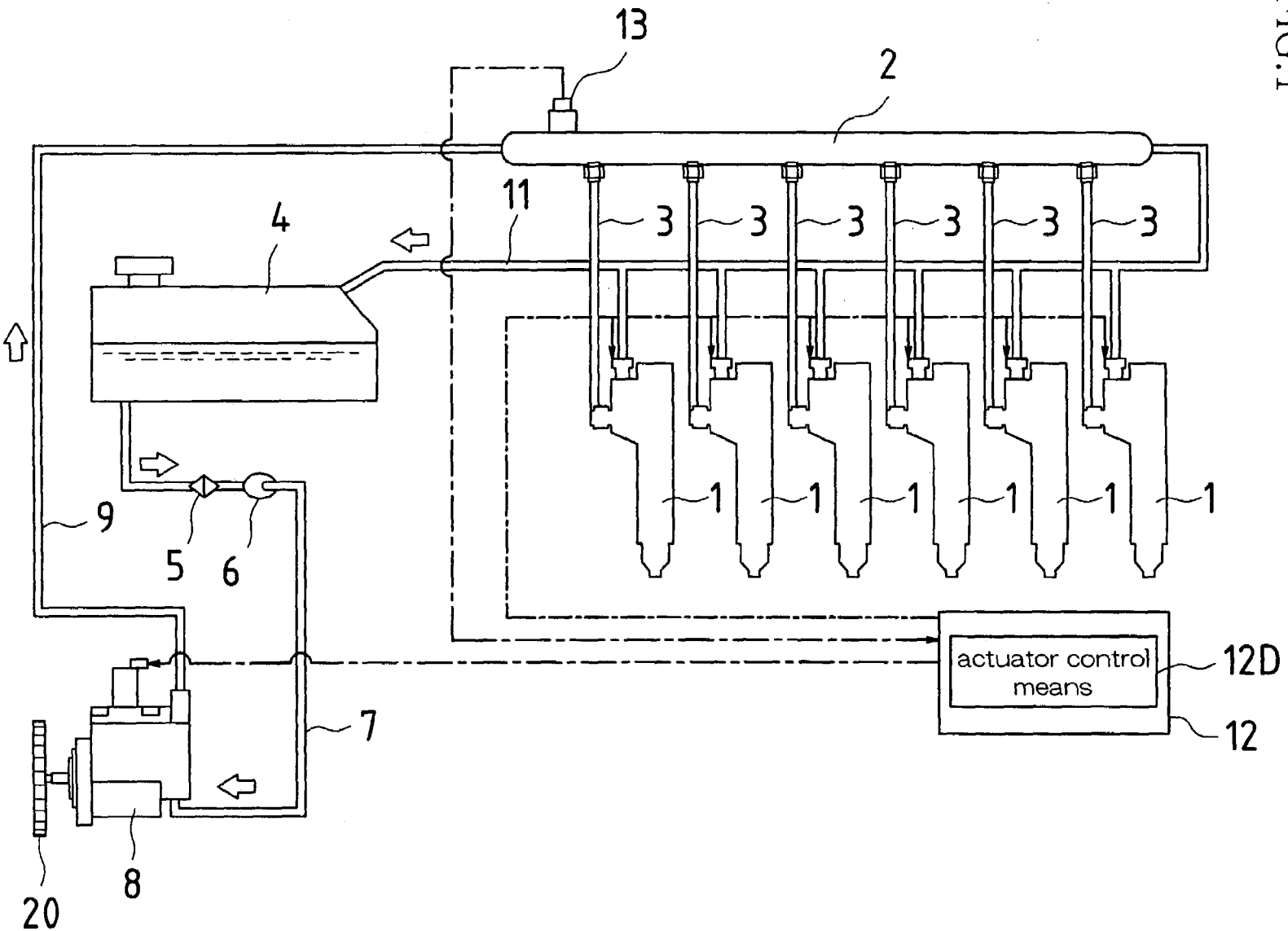
FIG. 1 is a diagram showing an accumulator-type fuel injection apparatus according to the first embodiment of the invention.

First, the overall configuration of the fuel injection apparatus that is adopted in the engine according to this first embodiment is described. FIG. 1 shows an accumulator-type fuel injection apparatus that is provided in a six-cylinder marine diesel engine.

This accumulator-type fuel injection apparatus is provided with a plurality of fuel injection valves (hereinafter, referred to simply as injectors) 1 each of which is attached to a corresponding cylinder of a diesel engine (hereinafter, referred to simply as engine), a common rail 2 that accumulates high-pressure fuel at a relatively high pressure (common rail internal pressure: 100 MPa, for example), a high-pressure pump 8 (in this invention, also called the pressurized fuel supply means) serving as a fuel pump that pressurizes the fuel that is sucked from a fuel tank 4 via a low-pressure pump (feed pump) 6 to a high pressure and then ejects it into the common rail 2, and a controller (ECU) 12 for electrically controlling the injectors 1 and the high-pressure pump 8.

The high-pressure pump 8 is, for example, a so-called plunger-type supply fuel supply pump that is driven by the engine and steps up the fuel to a high pressure that is determined based on the operation state, for example, and supplies this to the common rail 2 through a fuel supply piping 9. For example, the high-pressure pump 8 is linked to the crankshaft of the engine in such a manner that motive force transmission via a gear 20 (motive force transmission means in this invention) is possible. Other examples of the motive force transmission means configuration for achieving motive force transmission include providing both the driveshaft of the high-pressure pump 8 and the crankshaft of the engine with pulleys and then engaging a belt between the pulleys, and providing each shaft with a sprocket and engaging a chain between the sprockets.

Each injector 1 is attached to the downstream end of a fuel piping that is in communication with the common rail 2. The injection of fuel from the injectors 1 is, for example, controlled by conducting and stopping conduction of electricity (ON/OFF) to an injection control solenoid valve (not shown) that is integrally incorporated into the injector. That is, the injectors 1 inject the high-pressure fuel that has been supplied from the common rail 2 toward the combustion chamber of the engine while its injection control solenoid valve is open.

The controller 12 is supplied with various types of engine information such as the engine revolution and the engine load, and outputs control signals to the injection control solenoid valves so as to obtain the most suitable fuel injection timing and fuel injection amount, which are determined from these signals. At the same time, the controller 12 outputs a control signal to the high-pressure pump 8 so that the fuel injection pressure becomes an ideal value based on the engine revolution or the engine load. Further, a pressure sensor 13 for detecting the common rail internal pressure is attached to the common rail 2, and the amount of fuel that is ejected into the common rail 2 from the high-pressure pump 8 is controlled so that the signal of the pressure sensor 13 becomes a preset ideal value according to the engine revolution or engine load.

The operation for supplying fuel to each of the injectors 1 is performed through a branched pipe 3 that constitutes a portion of the fuel channel from the common rail 2. That is, fuel is taken up by the low-pressure pump 6 from the fuel tank 4 through a filter 5 and pressurized to a predetermined intake pressure and then delivered to the high-pressure pump 8 via the fuel pipe 7. The fuel that has been supplied to the high-pressure pump 8 is held in the common rail 2 still pressurized to the predetermined pressure, and is supplied to each of the injectors 1 from the common rail 2. A plurality of the injectors 1 are provided according to the engine type (number of cylinders; in the first embodiment, six cylinders), and under control by the controller 12, the injectors 1 inject the fuel that has been supplied from the common rail 2 into the corresponding combustion chamber at an optimum fuel injection amount and an optimum injection timing. The injection pressure at which the fuel is injected from the injectors 1 is substantially equal to the pressure of the fuel being held in the common rail 2, so that controlling the pressure within the common rail 2 allows the fuel injection pressure to be controlled.

Fuel that is supplied to the injectors 1 from the branched pipes 3 but is not consumed through injection to the combustion chamber, and surplus fuel in a case where the common rail internal pressure has been raised too high, is returned to the fuel tank 4 through a return pipe 11.

Information on the cylinder number and the crank angle is input to the controller 12, which is an electric control unit. The controller 12 stores, as mathematical functions, the target fuel injection conditions (for example, the target fuel injection timing, the target fuel injection amount, and the target common rail internal pressure), which are determined in advance based on the engine operation state so that the engine output becomes the ideal output for that operation state, and computes the target fuel injection conditions (that is, the fuel injection timing and the injection amount of the injector 1) in correspondence with the signals that indicate the current engine operation state, which is detected by various sensors, and then controls the operation of the injectors 1 and the fuel pressure within the common rail so that fuel injection is performed under those conditions.

Figure 2:
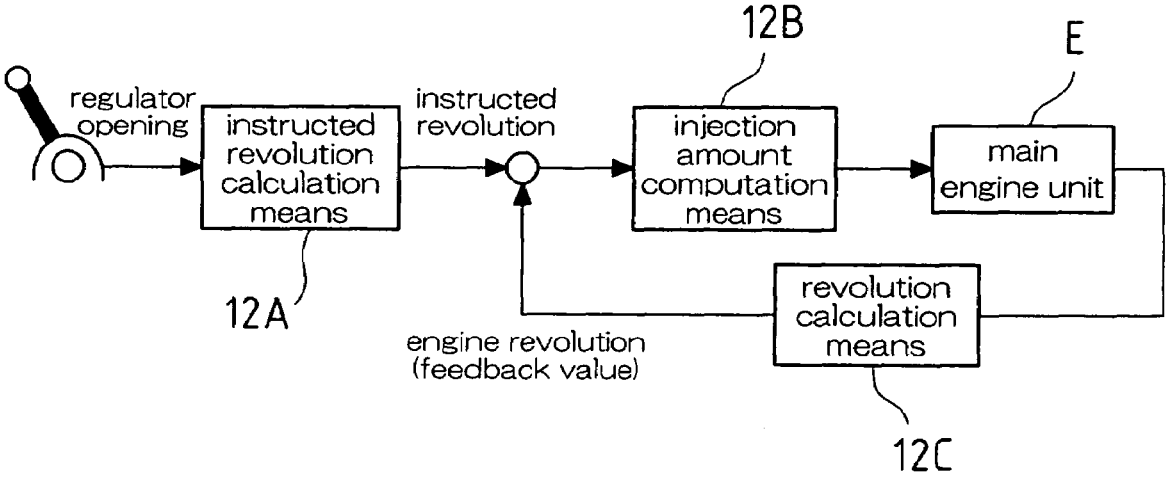
FIG. 2 is a control block diagram for determining the fuel injection amount.

FIG. 2 is a control block of the controller 12 for determining the fuel injection amount. As shown in FIG. 2, with regard to calculating the fuel injection amount, instructed revolution calculation means 12A receives a signal that indicates the degree of opening of a regulator, which is actuated by the user, and the instructed revolution calculation means 12A then calculates an "instructed revolution" corresponding to the degree of regulator opening. Then, injection amount computation means 12B computes the fuel injection amount such that the engine revolution becomes this instructed revolution. The injectors 1 of the main engine unit E perform fuel injection using the fuel injection amount that has been found through this computation, and in this state, revolution calculation means 12C calculates the actual engine revolution and compares this actual engine revolution with the instructed revolution and corrects the fuel injection amount so that the actual engine revolution becomes close to the instructed revolution (feedback control).

The first embodiment is characterized in how the crank shaft of the engine and the driveshaft of the high-pressure pump 8 are linked. An overview of the configuration of the high-pressure pump 8 will be provided before this linkage is described.

-Description of the High-Pressure Pump 8-

Figure 3:
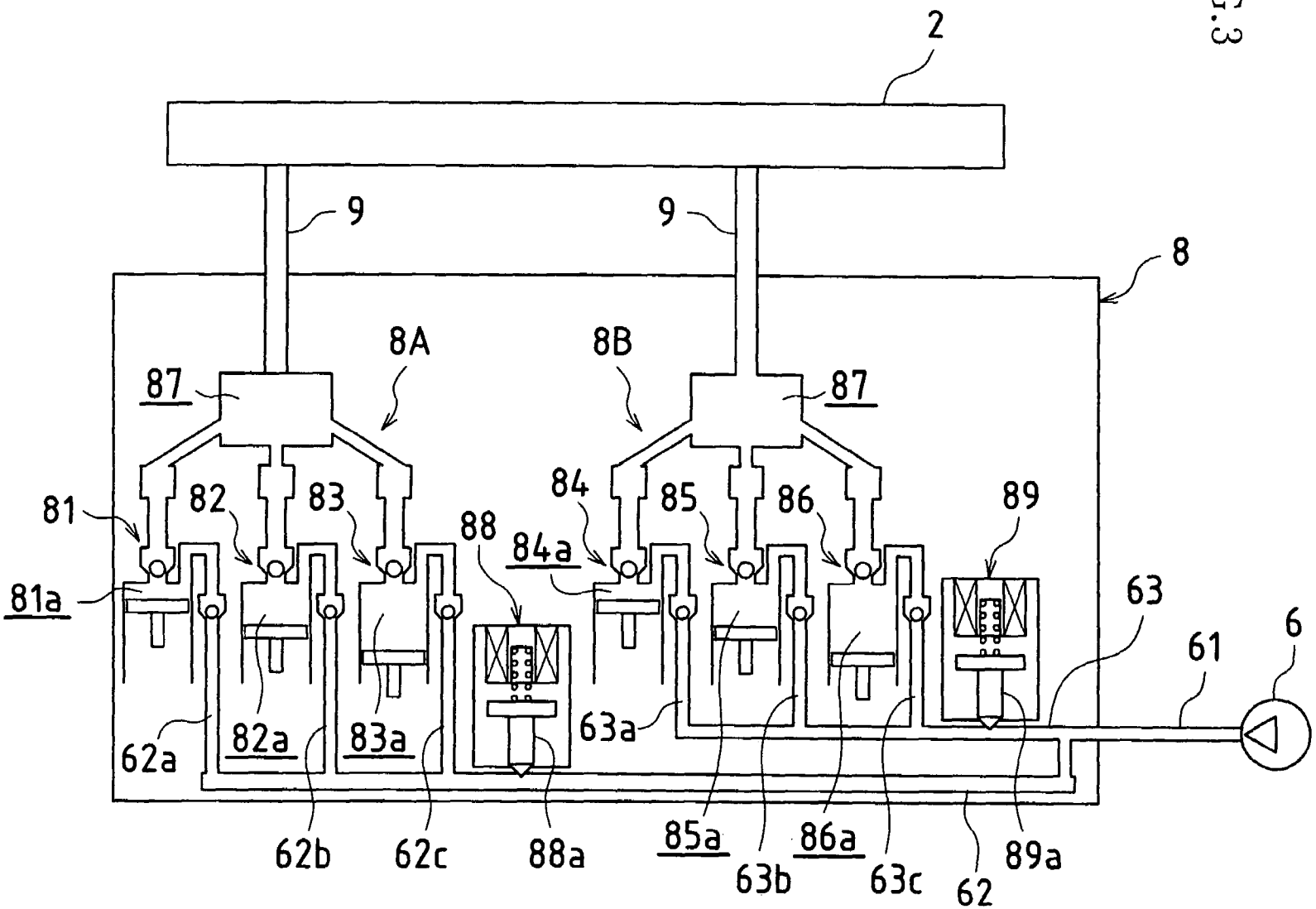
FIG. 3 is a is a diagram that schematically shows a schematic structure of the high-pressure pump, the low-pressure pump that is connected to the high-pressure pump, and the common rail.

FIG. 3 is a diagram that schematically shows the schematic structure of the high-pressure pump 8 and the manner in which the low-pressure pump 6 and the common rail 2 are connected to the high-pressure pump 8. As shown in FIG. 3, the high-pressure pump 8 is provided with six pump mechanisms (first pump mechanism 81 through sixth pump mechanism 86). That is to say, the pump mechanisms 81 to 86 each are made of a cylinder and a piston that moves back and forth in this cylinder, and a pump chamber (in this invention, the pressurized supply chamber) is formed in each pump mechanism 81 to 86 (first pump chamber 81*a* through sixth pump chamber 86*a*).

The pump mechanisms 81 to 86 perform an operation to provide a pressurized supply of fuel at different times. Specifically, the first pump mechanism 81 performs the operation to provide a pressurized supply of fuel, then the fourth pump mechanism 84 performs the operation to provide a pressurized supply of fuel, and subsequently the second pump mechanism 82, the fifth pump mechanism 85, the third pump mechanism 83, and the sixth pump mechanism 86, in that order, perform the operation to provide a pressurized supply of fuel. The revolution of the driveshaft of the high-pressure pump 8 coincides with the revolution of the crankshaft of the engine, and in one revolution of the crankshaft (one revolution of the driveshaft of the high-pressure pump 8: 360°) six operations to provide a pressurized supply of fuel are performed. In other words, the configuration of the high-pressure pump 8 is such that each time the crankshaft rotates by 60°, one of the pump mechanisms 81 to 86 performs the operation to provide a pressurized supply of fuel a single time.

These six pump mechanisms 81 to 86 are grouped into a first pump chamber group 8A and a second pump chamber group 8B (the pressurized fuel supply units in the invention). Specifically, the pump mechanisms 81 to 83 are grouped into the first pump chamber group 8A (the first group in the invention) and the pump mechanisms 84 to 86 are grouped into the second pump chamber group 8B (the second group in the invention). Thus, an ejection-side piping 61 of the low-pressure pump 6 branches into two lines, a first low-pressure piping 62 and a second low-pressure piping 63, and the first low-pressure piping 62 further branches into three branch pipings 62*a*, 62*b*, and 62*c* that correspond to the pump mechanisms 81 to 83 and that are independently connected to the pump chambers 81*a* to 83*a*, respectively. Similarly, the second low-pressure piping 63 further branches into three branch pipings 63*a*, 63*b*, and 63*c* that correspond to the pump mechanisms 84 to 86 and that are independently connected to the pump chambers 84*a* to 86*a*, respectively. It should be noted that the branch pipings 62*a* to 62*c* and 63*a* to 63*c* are furnished with a check valve for preventing the back flow of fuel from the pump chambers 81*a* to 86*a* toward the low-pressure pump 6. The ejection side of the pump chambers 81*a* to 86*a* is connected to a merge space 87 provided for each group 8A and 8B, and each merge space 87 is connected to the common rail 2 through the fuel supply piping 9. It should be noted that a check valve for preventing the back flow of fuel from the merge spaces 87 into the pump chambers 81*a* to 86*a* is provided on the ejection side of each pump chamber 81*a* to 86*a* as well.

The first low-pressure piping 62 and the second low-pressure piping 63 are provided with a first ejection amount control actuator 88 and a second ejection amount control actuator 89, respectively (the pressurized supply amount control mechanisms of the invention; hereinafter, referred to as the first actuator and the second actuator). These actuators 88 and 89 are provided with needle valves 88*a* and 89*a* that freely rise and fall into the low-pressure pipings 62 and 63, and the area of the opening of the low-pressure pipings 62 and 63 is varied due to the amount that the needle valves 88*a* and 89*a* protrude therein, therefore adjusting the amount of fuel that is supplied to the pump chambers 81*a* to 86*a* and allowing the common rail internal pressure to be adjusted. In other words, the lower the common rail internal pressure becomes, the larger the area of the opening of the low-pressure pipings 62 and 63 becomes and this increases the amount of fuel supplied to the pump chambers 81*a* to 86*a*, and in this way, the common rail internal pressure is raised to a target pressure.

The controller 12 is furnished with actuator control means 12D (see FIG. 1) for controlling the needle valve protrusion amount of the actuators 88 and 89. For example, the actuator control means 12D receives the common rail internal pressure signal from the pressure sensor 13, and when the common rail internal pressure is significantly lower than the target value, both actuators 88 and 89 are driven to reduce the needle valve protrusion amount and therefore increase the area of the opening of the low-pressure pipings 62 and 63. When, during idling operation, for example, demand by the main engine unit E for fuel injection is small and the common rail internal pressure is at the target value, then driving of the first actuator 88 is stopped, that is, the needle valve protrusion amount is set to the maximum amount so as to completely close the first low-pressure piping 62. Under these conditions, the driving of only the second actuator 89 is controlled so that the needle valve protrusion amount of the second actuator 89 is adjusted. In other words, in this state, only the pump mechanisms 84 to 86 that make up the second pump chamber group 8B perform the operation to provide a pressurized supply of fuel.

-Linkage Between the Crankshaft of the Main Engine Unit E and the Driveshaft of the High-Pressure Pump- Next, the manner in which the crankshaft of the main engine unit E and the driveshaft of the high-pressure pump 8 are linked is described. In the first embodiment, the two are linked so the phases of the rotation direction of crankshaft of the main engine unit E and the driveshaft of the high-pressure pump 8 are as follows.

That is, in a state where the operation to provide a pressurized supply of fuel is performed from only the second pump chamber group 8B, the two shafts are linked with their rotation phases coordinated (linked by a gear or belt as described above) so that the timing at which the load torque that acts on the driveshaft of the high-pressure pump 8 becomes a local minimum and the timing at which the load torque that acts on the crankshaft of the main engine unit E becomes a local maximum substantially coincide with one another, and the timing at which the load torque that acts on the driveshaft of the high-pressure pump 8 becomes a local maximum and the timing at which the load torque that acts on the crankshaft of the main engine unit E becomes a local minimum substantially coincide with one another.

Figure 4:
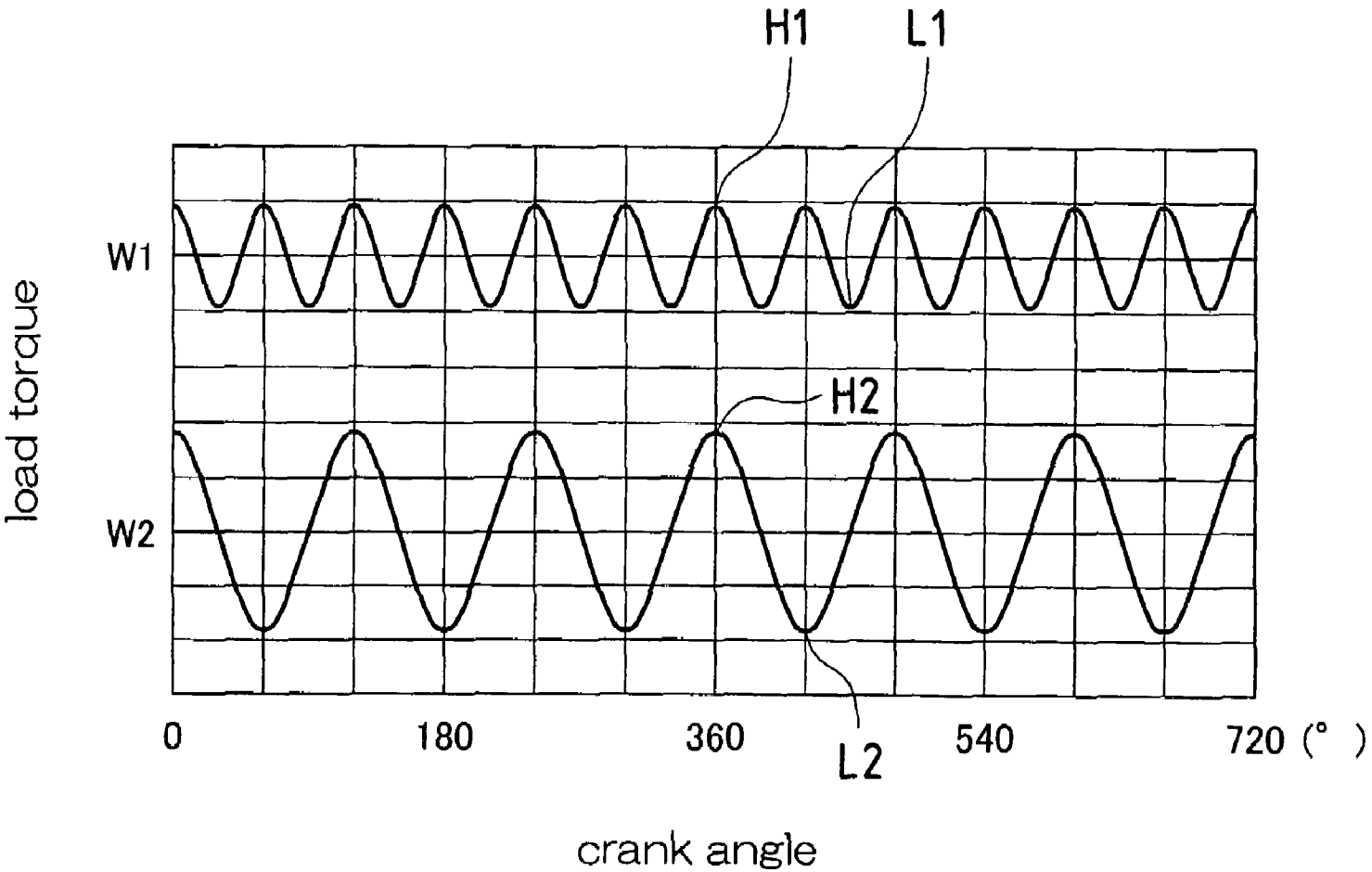
FIG. 4 is a diagram in which the waveform W1 indicates the fluctuation in the load torque that acts on the pump driveshaft when the operation to supply fuel under pressure is performed by pump chamber groups of the high-pressure pump, and the waveform W2 indicates the fluctuation in the load torque that acts on the pump driveshaft when the operation to supply fuel under pressure is performed by only the second pump chamber group.
Figure 5:
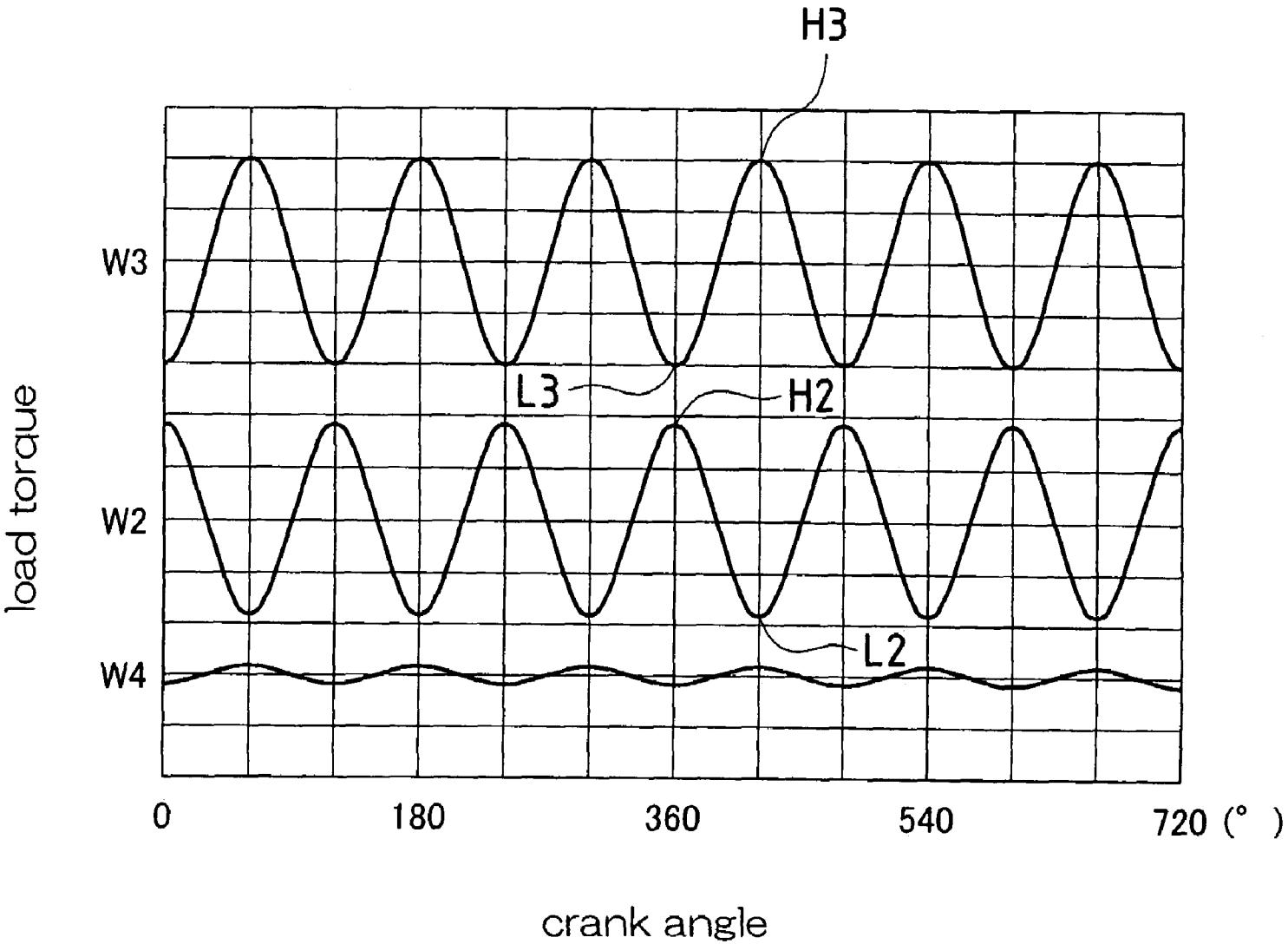
FIG. 5 is a diagram in which the waveform W3 indicates the load torque fluctuation waveform that acts on the crankshaft of the main engine unit, the waveform W2 indicates the fluctuation in the load torque that acts on the pump driveshaft when the operation to supply fuel under pressure is performed by only the second pump chamber group, and the waveform W4 indicates the fluctuation in the total load torque.

This is described specifically using FIG. 4 and FIG. 5. The horizontal axis in these figures is the rotation angle of the crankshaft of the main engine unit E, and the vertical axis indicates the load torque that acts on the shafts. FIG. 4 shows the fluctuation in the load torque that acts on the pump driveshaft when the operation to provide a pressurized supply of fuel is performed from the pump chamber groups 8A and 8B of the high-pressure pump 8 (the waveform W1 in the drawing), and the fluctuation in the load torque that acts on the pump driveshaft when the operation to provide a pressurized supply of fuel is performed from only the second pump chamber group 8B (the waveform W2 in the drawing).

As described above, when the high-pressure pump 8 is operating normally (the operation to provide a pressurized supply of fuel is being performed from both pump chamber groups 8A and 8B), the operation to provide a pressurized supply of fuel is performed six times over the course of one rotation of the crankshaft (one rotation of the driveshaft of the high-pressure pump 8: 360°), and thus, as shown by the waveform W1 in FIG. 4, the load torque that acts on the driveshaft of the high-pressure pump 8 fluctuates over with a period of 60° of the rotation angle. That is to say, the operation to provide a pressurized supply of fuel is performed twelve times over the course of a single cycle involving intake, compression, expansion, and discharge (during the period of a 720° rotation angle of the crankshaft) in a main engine unit E that is constituted by a four-stroke engine, and in this one cycle the load torque fluctuates over twelve periods. Here, the timing at which the load torque becomes a local maximum is the start point for the pressurized supply of fuel from one of the pump chambers (for example, the point H1 in FIG. 4). Also, the load torque becomes a local minimum at the point in time midway between the start point for the pressurized supply of fuel from one of the pump chambers to the start point for the pressurized supply of fuel from the pump chamber that will perform the next pressurized supply stroke (for example, the point L1 in FIG. 4).

On the other hand, when the operation to provide a pressurized supply of fuel is performed only by the second pump chamber group 8B due to control by the actuator control means 12D, then the operation to provide a pressurized supply of fuel is performed three times in one rotation of the crankshaft (one rotation of the driveshaft of the high-pressure pump 8: 360°), and thus, as shown by the waveform W2 in FIG. 4, the load torque that acts on the driveshaft of the high-pressure pump 8 fluctuates with a period of 120° of the rotation angle. That is to say, the load torque fluctuates over six periods in one cycle of the main engine unit E. Here, the timing at which the load torque becomes a local maximum (for example, the point H2 in FIG. 4) is the start point for the pressurized supply of fuel from any one of the pump chambers (any one of the pump chambers 84*a* to 86*a*). Also, the load torque becomes a local minimum at the point in time midway between the start point for the pressurized supply of fuel of one of the pump chambers to the start point for the pressurized supply of fuel of the pump chamber that will perform the next pressurized supply stroke (for example, in FIG. 4 this is denoted by the point L2).

Then, in this first embodiment, the two shafts are linked with their rotation phases coordinated, so that, as shown in FIG. 5, the load torque fluctuation waveform W2 when the operation to provide a pressurized supply of fuel is performed from only the second pump chamber group 8B is in synchronization with but opposite phase with respect to the load torque fluctuation waveform (the waveform W3 in FIG. 5) that acts on the crankshaft of the main engine unit E. In other words, when the operation to provide a pressurized supply of fuel is performed from only the second pump chamber group 8B, then the two shafts are linked with their rotation phases coordinated so that the load torque fluctuation cycle of the high-pressure pump 8 coincides with the load torque fluctuation cycle of the main engine unit E, the timing (L2) at which the load torque that acts on the driveshaft of the high-pressure pump 8 becomes a local minimum coincides with the timing (H3) at which the load torque that acts on the crankshaft of the main engine unit E becomes a local maximum, and the timing (H2) at which the load torque that acts on the driveshaft of the high-pressure pump 8 becomes a local maximum substantially coincides with the timing (L3) at which the load torque that acts on the crankshaft of the main engine unit E becomes a local minimum.

Specifically, the load torque that acts on the crankshaft of the main engine unit E becomes a local maximum at the moment that the compression stroke of any one of the cylinders is over. Also, this load torque becomes a local minimum at the point in time midway between the point that the compression stroke of one cylinder is over and the point that the compression stroke is over in the cylinder that performs a compression stroke next. Consequently, the two shafts are linked with their rotation phases coordinated so that the compression stroke end point of any cylinder of the main engine unit E coincides with the point where the load torque that acts on the driveshaft of the high-pressure pump 8 becomes a local minimum (the point in time midway between the point that the pressurized supply of fuel starts in one pump chamber and the point that the pressurized supply of fuel starts in the pump chamber in which the pressurized supply stroke is performed next), and so that the point that the load torque that acts on the crankshaft of the main engine unit E becomes a local minimum (the point in time midway between the point that the compression stroke of one cylinder is over and the point that the compression stroke is over in the cylinder that performs a compression stroke next) and the start point for the pressurized supply of fuel from any one of the pump chambers (any one of the pump chambers 84*a* to 86*a*) coincide with one another.

Thus, the fluctuation in the total torque load (the waveform W4 in FIG. 5), which is arrived at by superimposing the load torque that acts on the crankshaft of the engine and the load torque that acts on the driveshaft of the high-pressure pump 8, is suppressed because the waveforms W2 and W3 cancel each other out, and as a result vibration in the engine can be significantly suppressed.

In this way, in the first embodiment, the engine does not experience large vibration even when idling at low revolutions, and because idling operation at low revolutions can be achieved, it is possible to reduce noise and curtail fuel consumption. That is, it becomes possible to sufficiently take advantage of the benefit of idling operation at low revolutions by adopting an accumulator-type fuel injection apparatus.

In particular, in the first embodiment, half of the pump mechanisms 81 to 86 are stopped, and thus the range of fluctuation in the load torque that acts on the pump driveshaft can be made larger than when all of the pump mechanisms 81 to 86 are driven (the amplitude of the waveform W2 is larger than the waveform W1 in FIG. 4), and this allows the range of fluctuation in this load torque to be increased to about the same degree as the range of fluctuation in the load torque that acts on the crankshaft of the main engine unit E, and thus fluctuation in the total load torque can be effectively suppressed.

Second Embodiment

The second embodiment describes a case in which the invention is adopted in an accumulator-type fuel injection apparatus that is provided in a fuel supply system of a six-cylinder marine diesel engine. It should be noted that other than the features described below, this embodiment is similar to the first embodiment, and thus identical structural elements shall be assigned identical reference numerals and the description focuses on the differences between them.

Figure 6:
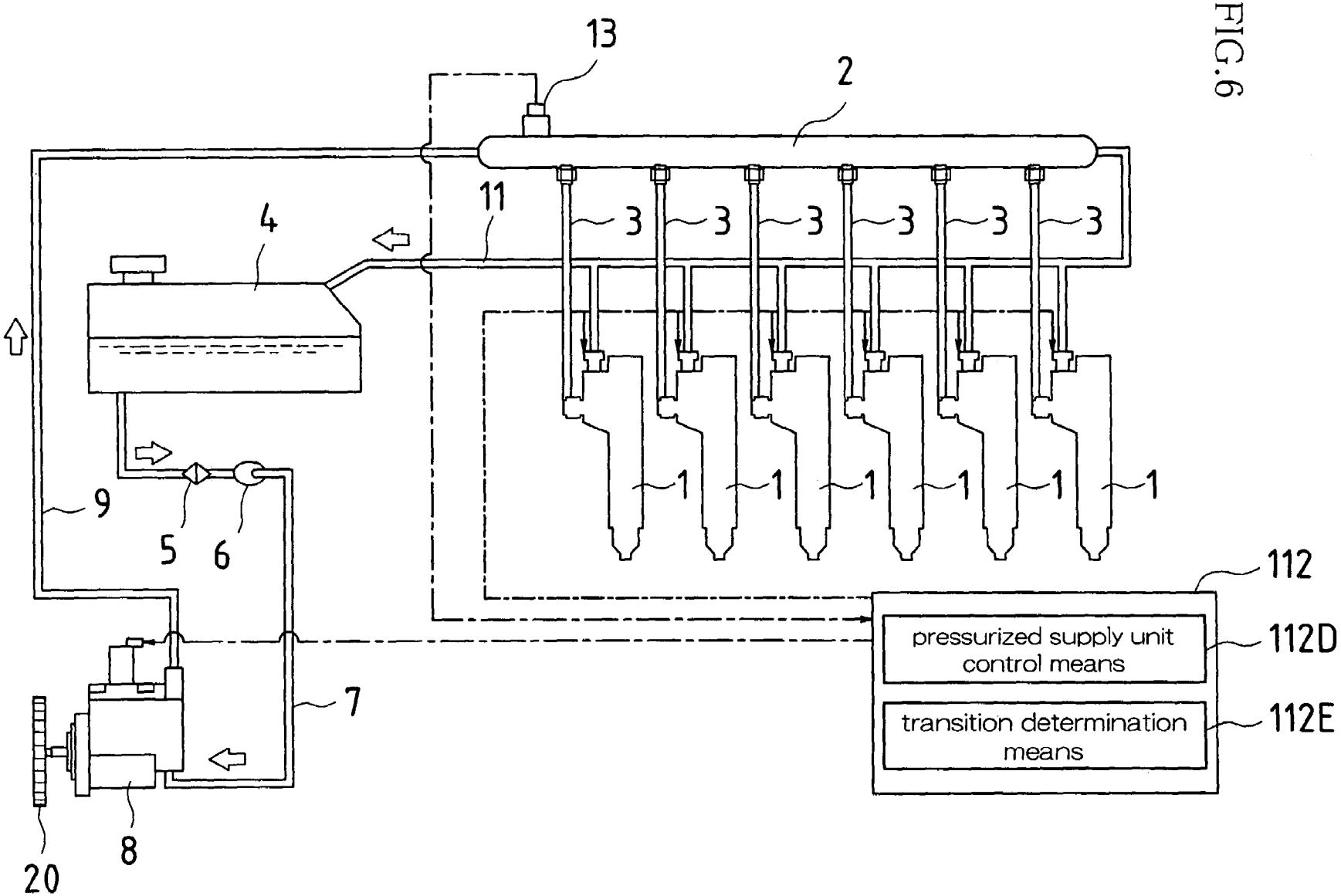
FIG. 6 is a diagram that shows an accumulator-type fuel injection apparatus according to the second embodiment.

FIG. 6 shows an accumulator-type fuel injection apparatus provided in a six-cylinder marine diesel engine according to the second embodiment. The second embodiment is characterized in that the drive state of the high-pressure pump 8 can be switched in accordance with the operation state of the main engine unit E.

Thus, a controller 112 of the second embodiment is furnished with pressurized supply unit control means 112D for controlling the operation by the pump chamber groups 8A and 8B to provide the pressurized supply of fuel, and transition determination means 112E, in place of the actuator control means 12D of the controller 12 of the first embodiment.

The pressurized supply unit control means 112D switches between a case in which both the first pump chamber group 8A and the second pump chamber group 8B are driven, and a case in which the first pump chamber group 8A is forcibly stopped and only the second pump chamber group 8B is driven.

Specifically, the pressurized supply unit control means 112D controls the needle valve protrusion amount of the actuators 88 and 89. By reducing the needle valve protrusion amount to increase the area of the opening in the low-pressure pipings 62 and 63, the fuel that is supplied under pressure from that pump chamber group is increased, and conversely, by increasing the needle valve protrusion amount to reduce the area of the opening in the low-pressure pipings 62 and 63, the fuel that is supplied under pressure from that pump chamber group is decreased. Setting the needle valve protrusion amount to the maximum amount completely closes off the low-pressure pipings 62 and 63 and results in a state where fuel is not fed under pressure from that pump chamber group, that is, a state in which driving of that pump chamber group has been stopped.

More specifically, the pressurized supply unit control means 112D receives an engine revolution signal and a fuel injection amount signal, etc., and for example, when the engine is operating at high revolutions and demand for fuel by the main engine unit E cannot be met without driving both pump chamber groups 8A and 8B, then both pump chamber groups 8A and 8B are driven to supply fuel to the common rail 2 under pressure (hereinafter, referred to as the dual actuator drive state). In contrast to this, when, for example, the engine is operating at low revolutions and the demand by the engine for the pressurized supply of fuel can be met by driving only the second pump chamber group 8B, then the first pump chamber group 8A is forcibly stopped (the needle valve protrusion amount of the first actuator 88 is increased to the maximum amount so as to completely close off the first low-pressure piping 62; hereinafter, referred to as the single actuator drive state). By doing this, the pressurized supply of fuel to the common rail 2 is performed by only the second pump chamber group 8B.

In this manner, when the pressurized supply of fuel to the common rail 2 is performed by the second pump chamber group 8B only, the adjustment precision can be improved over that when both the pump chamber groups 8A and 8B are driven. For example, take an example in which 101/min is the maximum pump ejection amount when both the first and the second pump chamber groups are used, and it is necessary to change to current from 0 to 2 A in order to alter the pump ejection amount from 0 to the maximum value, then the control resolution of the pumps is 51/min/A. In a case where only the second pump chamber group is used, the maximum pump ejection amount is only half at 51/min but the current for increasing the pump ejection amount from 0 to the maximum value does not change, and as a result the pump control resolution is halved to 2.51/min/A. That is to say, the change in ejection amount with respect to the actuator drive current is halved and thus the control resolution can be increased, and this allows the adjustment precision to be increased.

Figure 7:
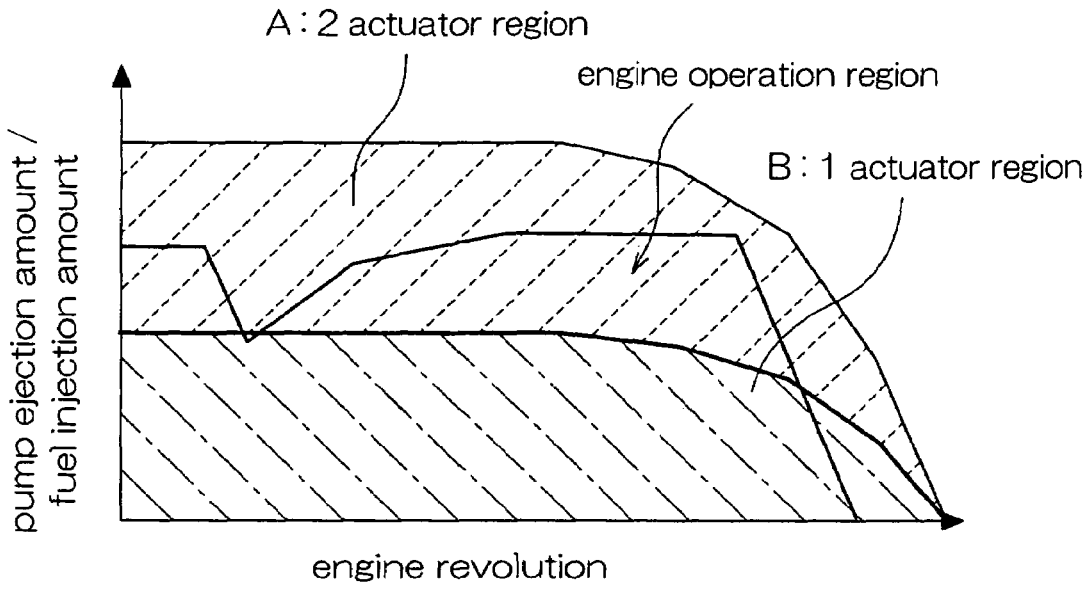
FIG. 7 is a diagram that shows a map for switching between the dual actuator drive state and the single actuator drive state.

FIG. 7 shows a map for switching between the dual actuator drive state and the single actuator drive state according to the engine revolution and the fuel injection amount. The region A in this map (the region indicated by the oblique dashed lines) indicates the region in which the dual actuator drive state is in effect (the 2 actuator region), and the region B (the region indicated by the oblique long-short dashed lines) indicates the region in which the single actuator drive state is in effect (the state in which only the second actuator 89 is driven; the 1 actuator region). In this way, the dual actuator drive state and the single actuator drive state are switched between according to the engine revolution and the fuel injection amount.

Figure 8:
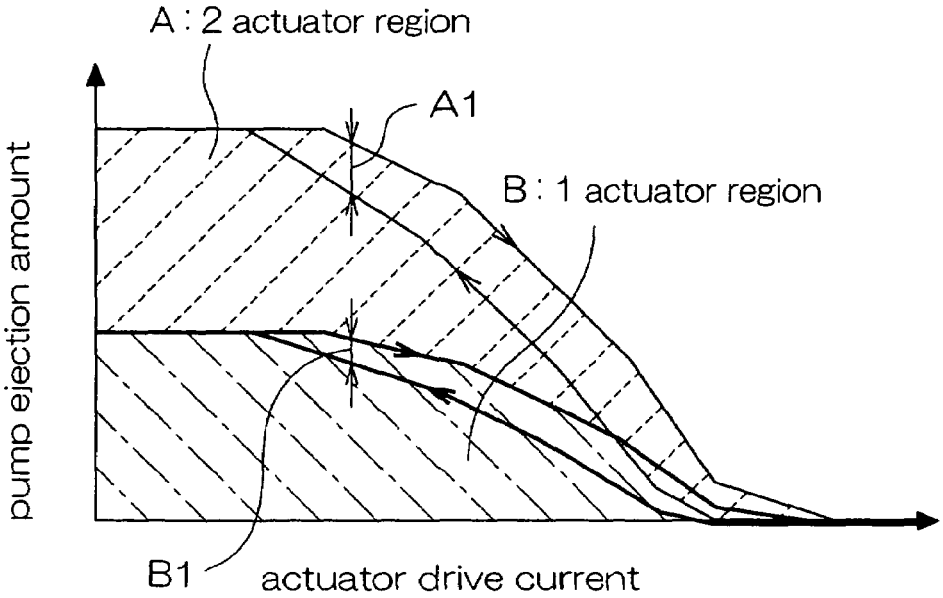
FIG. 8 is a diagram that shows the hysteresis of the switch determination value when switching the number of pump chamber groups to drive.
Figure 9:
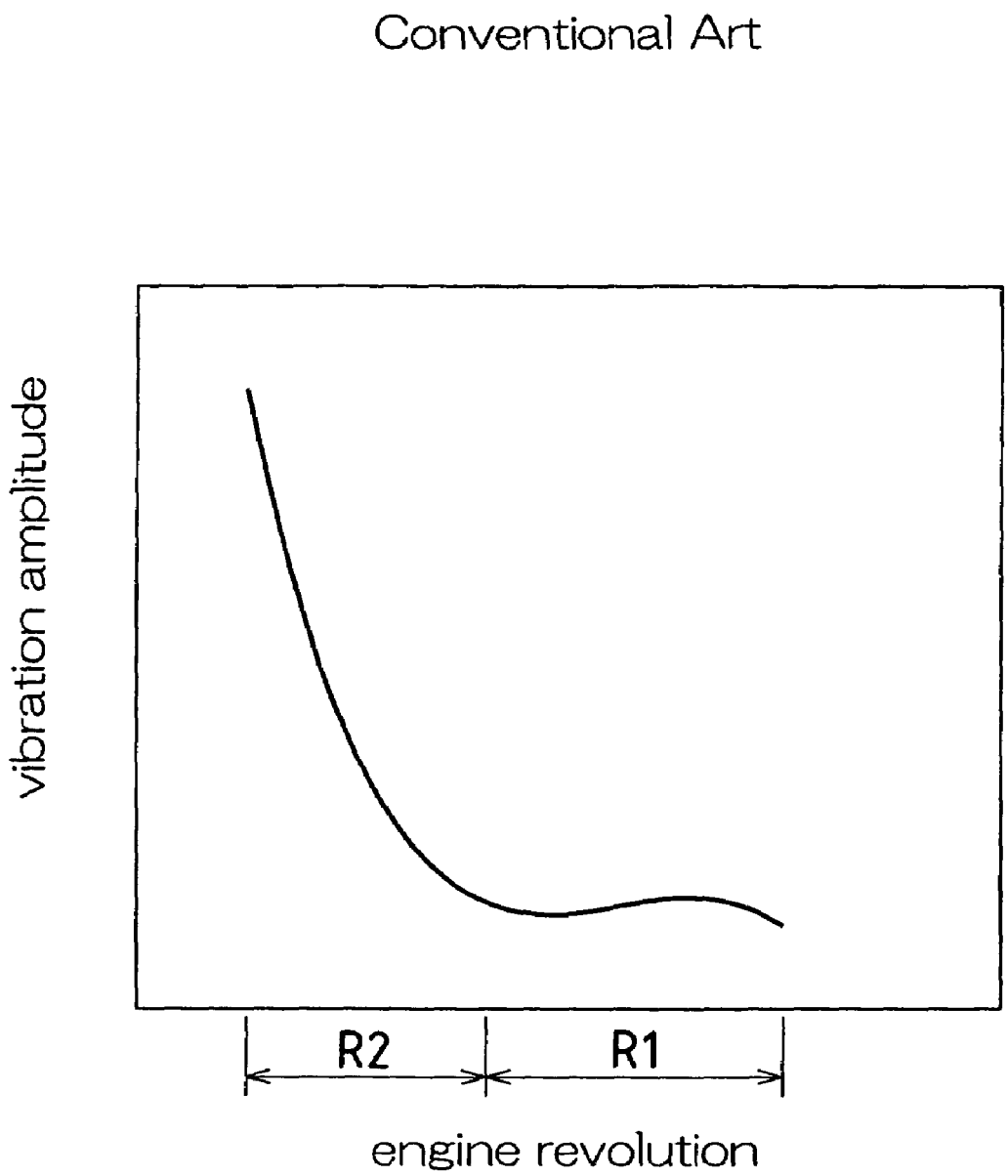
FIG. 9 is a diagram that shows an example of the relationship between the engine revolution and the amplitude of the vibration of the engine in the idling operation region.

FIG. 8 shows how hysteresis is given to the determination value with which to perform the switch determination when the pressurized supply unit control means 112D switches+ the number of pump chamber groups 8A and 8B to drive. In FIG. 8 as well, the 2 actuator region is indicated by oblique dashed lines and the 1 actuator region is indicated by oblique long-short dashed lines.

Giving hysteresis to the determination value in this way makes it possible to avoid the hunting phenomenon that the number of pump chamber groups 8A and 8B to drive is switched frequently, and thus the stability of the drive operation of the high-pressure pump 8 can be maintained. It should be noted that in the second embodiment, the hysteresis width in the single actuator drive state (the width B1 in FIG. 8) is set to approximately one half the hysteresis width in the dual actuator drive state (the width A1 in FIG. 8). This allows an increase in control precision to be achieved.

As mentioned above, the controller 112 is furnished with transition determination means 112E, and based on the signal from the transition determination means 112E it is possible to forcibly stop the control by the pressurized supply unit control means 112D. Specifically, the transition determination means 112E can, for example, detect that the regulator opening has suddenly increased (that a demand for a sudden increase in the engine revolution has occurred) and determine whether or not the operation of the main engine unit E is in a transient state. When the pressurized supply unit control means 112D receives a transition determination signal from the transition determination means 112E, it cancels the above operation of forcibly stopping part of the pump chamber groups, and drives both of the pump chamber groups 8A and 8B so that they both perform the operation of providing a pressurized supply of fuel to the common rail 2. Thus, the above demand (the demand for a sudden increase in the engine revolution) can be rapidly met.

Other Embodiments

The above embodiments describe cases in which the invention is adopted in a six-cylinder marine diesel engine. The present invention is not limited to this, however, and it can be adopted for various engine types, including four-cylinder marine diesel engines. The invention also is not limited to marine engines, and can be adopted in engines that are used in other applications such as automobiles.

Also, in the above embodiment, driving of the first actuator 88 is stopped so that only the second actuator 89 is driven in order to supply pressurized fuel from only the second pump chamber group 8B when the fuel injection amount that is required by the main engine unit E is small and the common rail internal pressure has reached the target pressure, but it is also possible for fuel to be supplied under pressure from only the second pump chamber group 8B in accordance with other conditions (for example, the engine revolution or the cooling water temperature) as well.

Further, in the foregoing embodiments the pump mechanisms 81 to 86 were divided into two groups and two actuators 88 and 89 were provided, but it is also possible to adopt a configuration in which the pump mechanisms are divided into three or more groups and three or more actuators are provided, in which by selectively driving only part of these actuators it is possible to suppress fluctuation in the total load torque and increase the adjustment precision.

It should be noted that the present invention can be worked in various other forms without deviating from the basic characteristics or the spirit thereof. Accordingly, the embodiments given above are in all respects nothing more than examples, and should not be interpreted as being limiting in nature. The scope of the present invention is indicated by the claims, and is not restricted in any way to the text of this specification. Furthermore, all modifications and variations belonging to equivalent claims of the patent claims are within the scope of the present invention.

Also, this application claims priority right on the basis of Japanese Patent Application 2004-204351 and Japanese Patent Application 2004-204352 submitted in Japan on Jul.

12, 2004. The entire contents of these are herein incorporated by reference. The documents cited in this specification are herein specifically incorporated in their entirety by reference.

Industrial Applicability

The present invention is ideal for various types of engines, including six-cylinder marine diesel engines and four-cylinder marine diesel engines. There is no limitation to marine engines, however, and the invention also is ideal for engines that are used in other applications as well, such as in automobiles.

The invention claimed is:

1. An internal combustion engine furnished with an accumulator-type fuel injection apparatus, comprising a fuel pump that receives a drive force from a driveshaft of a main internal combustion engine unit through motive force transmission means and performs an operation to provide a pressurized supply of fuel, a common rail for holding the fuel that has been supplied under pressure from the fuel pump, and a fuel injection valve that injects fuel that has been supplied from the common rail toward a combustion chamber of the main internal combustion engine unit, wherein the driveshaft of the main internal combustion engine unit and the driveshaft of the fuel pump are linked by the motive force transmission means to rotate at the same speed and with the rotation phases of the driveshafts coordinated so that a timing at which a load torque that acts on the driveshaft of the main internal combustion engine unit becomes a local maximum and a timing at which a load torque that acts on the driveshaft of the fuel pump becomes a local minimum substantially coincide with one another, wherein the fuel pump is furnished with a plurality of pressurized supply chambers, each of which performs an operation to provide a pressurized supply of fuel at a different timing, and these pressurized supply chambers are divided into a plurality of groups, each of which is furnished with a pressurized supply amount control mechanism for adjusting the amount of fuel that is supplied under pressure from the pressurized supply chambers to the common rail, and wherein by selectively driving only part of the plurality of pressurized supply amount control mechanisms, fuel is supplied under pressure to the common rail from only the pressurized supply chambers of a specific group or groups, and by doing this, the load torque fluctuation cycle of the fuel pump is made to substantially coincide with the load torque fluctuation cycle of the internal combustion engine, the timing at which the load torque that acts on the driveshaft of the fuel pump becomes a local minimum is made to substantially coincide with the timing at which the load torque that acts on the driveshaft of the main internal combustion engine unit becomes a local maximum, and the timing at which the load torque that acts on the driveshaft of the fuel pump becomes a local maximum is made to substantially coincide with the timing at which the load torque that acts on the driveshaft of the main internal combustion engine unit becomes a local minimum.

2. The internal combustion engine furnished with an accumulator-type fuel injection apparatus according to claim 1, wherein the main internal combustion engine unit is a multi-cylinder four-stroke engine, the fuel pump is provided with the same number of pressurized supply chambers as the number of cylinders in the main internal combustion engine unit, and these pressurized supply chambers are grouped half into a first group and half into a second group and each group is furnished with a pressurized supply amount control mechanism, wherein, when the operation to provide a pressurized supply of fuel has been performed from only the pressurized supply chambers of the second group, the driveshaft of the main internal combustion engine unit and the driveshaft of the fuel pump are linked by the motive force transmission means in such a manner that the timing at which the load torque that acts on the driveshaft of the fuel pump becomes a local minimum substantially coincides with the timing at which the load torque that acts on the driveshaft of the main internal combustion engine unit becomes a local maximum, and the timing at which the load torque that acts on the driveshaft of the fuel pump becomes a local maximum substantially coincides with the timing at which the load torque that acts on the driveshaft of the main internal combustion engine unit becomes a local minimum, and wherein driving only the pressurized supply amount control mechanism of the second group, of the two pressurized supply amount control mechanisms, suppresses fluctuation in the total load torque, which is arrived at by superimposing the two load torques.

3. An internal combustion engine furnished with an accumulator-type fuel injection apparatus, comprising a fuel pump that receives a drive force from a driveshaft of a main internal combustion engine unit through motive force transmission means and performs an operation to provide a pressurized supply of fuel, a common rail for holding the fuel that has been supplied under pressure from the fuel pump, and a fuel injection valve that injects fuel that has been supplied from the common rail toward a combustion chamber of the main internal combustion engine unit, wherein the driveshaft of the main internal combustion engine unit and the driveshaft of the fuel pump are linked by the motive force transmission means to rotate at the same speed and with the rotation phases of the driveshafts coordinated so that a timing at which a load torque that acts on the driveshaft of the main internal combustion engine unit becomes a local maximum and a timing at which a load torque that acts on the driveshaft of the fuel pump becomes a local minimum substantially coincide with one another, wherein the driveshaft of the main internal combustion engine unit and the driveshaft of the fuel pump are linked by the motive force transmission means in such a manner that the load torque fluctuation cycle of the driveshaft of the main internal combustion engine unit substantially coincides with the load torque fluctuation cycle of the driveshaft of the fuel pump, the timing at which the load torque that acts on the driveshaft of the main internal combustion engine unit becomes a local maximum substantially coincides with the timing at which the load torque that acts on the driveshaft of the fuel pump becomes a local minimum, and the timing at which the load torque that acts on the driveshaft of the main internal combustion engine unit becomes a local minimum substantially coincides with the timing at which the load torque that acts on the driveshaft of the fuel pump becomes a local maximum, wherein the fuel pump is furnished with a plurality of pressurized supply chambers, each of which performs an operation to provide a pressurized supply of fuel at a different timing, and these pressurized supply chambers are divided into a plurality of groups, each of which is furnished with a pressurized supply amount control mechanism for adjusting the amount of fuel that is supplied under pressure from the pressurized supply chambers to the common rail, and wherein by selectively driving only part of the plurality of pressurized supply amount control mechanisms, fuel is supplied under pressure to the common rail from only the pressurized supply chambers of a specific group or groups, and by doing this, the load torque fluctuation cycle of the fuel pump is made to substantially coincide with the load torque fluctuation cycle of the internal combustion engine, the timing at which the load torque that acts on the driveshaft of the fuel pump becomes a local minimum is made to substantially coincide with the timing at which the load torque that acts on the driveshaft of the main internal combustion engine unit becomes a local maximum, and the timing at which the load torque that acts on the driveshaft of the fuel pump becomes a local maximum is made to substantially coincide with the timing at which the load torque that acts on the driveshaft of the main internal combustion engine unit becomes a local minimum.

4. The internal combustion engine furnished with an accumulator-type fuel injection apparatus according to claim 3, wherein the main internal combustion engine unit is a multi-cylinder four-stroke engine, the fuel pump is provided with the same number of pressurized supply chambers as the number of cylinders in the main internal combustion engine unit, and these pressurized supply chambers are grouped half into a first group and half into a second group and each group is furnished with a pressurized supply amount control mechanism, wherein, when the operation to provide a pressurized supply of fuel has been performed from only the pressurized supply chambers of the second group, the driveshaft of the main internal combustion engine unit and the driveshaft of the fuel pump are linked by the motive force transmission means in such a manner that the timing at which the load torque that acts on the driveshaft of the fuel pump becomes a local minimum substantially coincides with the timing at which the load torque that acts on the driveshaft of the main internal combustion engine unit becomes a local maximum, and the timing at which the load torque that acts on the driveshaft of the fuel pump becomes a local maximum substantially coincides with the timing at which the load torque that acts on the driveshaft of the main internal combustion engine unit becomes a local minimum; and wherein driving only the pressurized supply amount control mechanism of the second group, of the two pressurized supply amount control mechanisms, suppresses fluctuation in the total load torque, which is arrived at by superimposing the two load torques.

* * * * *